US007594536B2

(12) United States Patent
Sugihara et al.

(10) Patent No.: US 7,594,536 B2
(45) Date of Patent: Sep. 29, 2009

(54) EGR COOLER

(75) Inventors: Hiroyuki Sugihara, Hino (JP); Makoto Tsujita, Tokyo (JP); Yoji Yamashita, Tokyo (JP); Naoto Miwa, Tokyo (JP); Junji Honma, Tokyo (JP)

(73) Assignees: Hino Motors, Ltd., Hino-shi (JP); Sankyo Radiator Co., Ltd., Hachioji-shi (JP)

( * ) Notice: Subject to any disclaimer, the term of this patent is extended or adjusted under 35 U.S.C. 154(b) by 450 days.

(21) Appl. No.: 10/530,057

(22) PCT Filed: May 22, 2003

(86) PCT No.: PCT/JP03/06401

§ 371 (c)(1),
(2), (4) Date: Apr. 4, 2005

(87) PCT Pub. No.: WO2004/031565

PCT Pub. Date: Apr. 15, 2004

(65) Prior Publication Data

US 2006/0090880 A1 May 4, 2006

(30) Foreign Application Priority Data

Oct. 2, 2002 (JP) ..... 2002-289833
Oct. 2, 2002 (JP) ..... 2002-289834

(51) Int. Cl.
*F02M 25/07* (2006.01)
*F28D 7/16* (2006.01)

(52) U.S. Cl. ..... 165/41; 165/51; 165/101; 165/103; 165/160; 60/278; 60/320; 123/568.12

(58) Field of Classification Search ..... 165/41, 165/51, 103, 101, 160; 60/278, 320; 123/568.12
See application file for complete search history.

(56) References Cited

U.S. PATENT DOCUMENTS

| | | | | |
|---|---|---|---|---|
| 2,322,047 | A * | 6/1943 | Mormile | 165/103 |
| 2,922,441 | A * | 1/1960 | Klute | 138/37 |
| 3,735,811 | A * | 5/1973 | Moser et al. | 165/160 |
| 7,073,576 | B2 * | 7/2006 | Peirasso | 165/297 |

FOREIGN PATENT DOCUMENTS

| | | | |
|---|---|---|---|
| JP | 48-019178 | | 5/1973 |
| JP | 53-078470 | | 7/1978 |
| JP | 55-014905 | | 1/1980 |
| JP | 1-300192 | | 12/1989 |
| JP | 5-203388 | | 8/1993 |
| JP | 11280563 | A * | 10/1999 |
| JP | 2000-045884 | | 2/2000 |
| JP | 2000234566 | A * | 8/2000 |
| JP | 2000-283666 | | 10/2000 |
| JP | 2000-292089 | | 10/2000 |
| JP | 2000274990 | A * | 10/2000 |
| WO | 00/43663 | | 7/2000 |

* cited by examiner

*Primary Examiner*—John K Ford
(74) *Attorney, Agent, or Firm*—Oblon, Spivak, McClelland, Maier & Neustadt, L.L.P.

(57) ABSTRACT

An EGR cooler including tubes and a shell enclosing the tubes. Cooling water is supplied into and discharged from the shell. Exhaust gas is guided from a diesel engine into the tubes for thermal exchange of the exhaust gas with the cooling water. A bypass flow path for guiding the cooling water is constituted within the shell so as to prevent stagnation of the cooling water in the shell.

2 Claims, 10 Drawing Sheets a<b<c a' <b' <c'

$a < b < c$ $a' < b' < c'$

EGR COOLER

TECHNICAL FIELD

The present invention relates to an EGR cooler attached to an EGR apparatus, which recirculates exhaust gas from a diesel engine to suppress generation of nitrogen oxides, so as to cool the exhaust gas to be recirculated.

BACKGROUND ART

An EGR apparatus is known which recirculates part of exhaust gas from an engine in a vehicle or the like to the engine to suppress generation of nitrogen oxides. Some of such EGR apparatuses are equipped with, midway of an exhaust gas recirculation line to the engine, an EGR cooler for cooling the exhaust gas since cooling the exhaust gas to be recirculated to the engine will drop the temperature of and reduce the volume of the exhaust gas to lower the combustion temperature in the engine without substantial decrease of output of the engine, thereby effectively suppressing generation of nitrogen oxides. Known in this regard is, for example, JP 2001-74380 A.

FIGS. 1 and 2 are sectional views showing a first example of the above-mentioned EGR cooler in which reference numeral 1 denotes a cylindrical shell with axial opposite ends to which plates 2 are respectively fixed to close the ends of the shell 1. A number of tubes 3 extend axially within the shell 1 and are penetratingly fixed at their opposite ends to the respective plates 2.

Cooling water inlet and outlet 4 and 5 are attached to the shell 1 near one and the other end thereof, respectively, so that cooling water 9 is supplied via the inlet 4 into the shell 1, flows outside of the tubes 3 and is discharged out of the shell 1 from the outlet 5.

The respective plates 2 have, on their sides away from the shell 1, bowl-shaped hoods 6 fixed to the plates 2 so as to enclose end faces of the plates 2. The one and the other hoods 6 provide central gas inlet and outlet 7 and 8, respectively, so that the exhaust gas 10 from the engine enters via the gas inlet 7 into the one hood 6, is cooled during passage through the tubes 3 by heat exchange with the cooling water 9 flowing outside of the tubes 3 and is discharged from the gas outlet 8 to the other hood 6 to be recirculated to the engine. In FIG. 1, reference letter x denotes axial extension line for the shell 1.

However, such EGR cooler shown in the first example is disadvantageous in that the cooling water 9 supplied via the inlet 4 into the shell 1 nonuniformly flows to the outlet 5 with respect to internal cross section of the shell 1, so that the cooling water 9 may stagnate near corners on opposite sides of the inlet 4 and outlet 5 in the shell 1 as shown by a course 11 to generate cooling water stagnation zones 12, resulting in localized high temperature of and thus thermal deformation of the tubes 3 near the stagnation zones 12.

To overcome this, a second example of an EGR cooler as shown in FIG. 3 is provided which has a bypass conduit 14 extending outside from the shell 1, at a position diametrically opposite to the inlet 4, to the outlet 5. The conduit 14 drains part of the cooling water 9 having been introduced via the inlet 4 so as not to cause stagnation of the cooling water 9 and to prevent the stagnation zone 12 from being generated at the diametrically opposite position to the inlet 4, thereby suppressing any localized high temperature of the tubes 3.

However, in the second example of the EGR cooler, arrangement of the bypass conduit 14 outside of the shell 1 is disadvantageous in that it interferes with peripheral devices of the shell 1 to substantially lower mountability onto a vehicle.

Thus, the invention was made in view of the above and has its object to provide an EGR cooler which prevents generation of cooling-water stagnation zones and improves its mountability onto a vehicle.

Conventional EGR coolers include a third example. Known as such is, for example, JP 2000-213424 A.

FIG. 4 is a sectional view showing the third example of an EGR cooler in which reference numeral 31 denotes a cylindrical shell with axially opposite ends to which plates 32 are respectively fixed to close the ends of the shell 31. A number of tubes 33 substantially of the same diameter extend axially within the shell 31 and are penetratingly fixed at their opposite ends to the respective plates 32.

Cooling water inlet and outlet 34 and 35 are fixed from outside to the shell 31 near one and the other ends thereof, respectively, so that cooling water 39 is supplied via the inlet 34 into the shell 31 to flow outside of the tubes 33 and is discharged via the outlet 35 outside of the shell 31.

The respective plates 32 have, on their sides away from the shell 31, bowl-shaped hoods 36 fixed to the plates 32 so as to enclose end faces thereof. The one and the other hoods 36 provide central exhaust-gas inlet and outlet 37 and 38, respectively, so that exhaust gas 40 from the engine enters via the inlet 37 into the one hood 36, is cooled during passage through the tubes 33, by heat exchange with the cooling water 39 flowing outside of the tubes 33 and is discharged via the outlet 38 to the other hood 36 to be recirculated to the engine.

In the figure, reference numeral 41 denotes a bypass outlet conduit which is arranged on the shell 31 at a position diametrically opposite to the inlet conduit 34 and which drains part of the cooling water 39 to prevent stagnation of the cooling water 39 at the position opposite to the inlet conduit 34.

The tubes 33 are arranged as shown in FIG. 5 such that the plural tubes 33 with the same diameter are at a constant pitch in the form of concentric circles about the axis O the shell 31, the peripheral tubes 33 being positioned along the shell 1 while a central tube **33*a* is positioned at an axis O of the shell 31**.

However, even with the third example of the EGR cooler having the tubes 33 arranged at the constant pitch in the form of concentric circles about the axis O of the shell 31, the hot exhaust gas 40 via the inlet 37 tends to flow more through the tubes 33 on the center side than through the tubes on the peripheral side, so that the tubes 33 on the center side may become higher temperature than those on the peripheral side, resulting in possibility of localized thermal deformation and deteriorated heat exchange efficiency.

Thus, the invention was made in view of the above and has its object to provide an EGR cooler in which tubes on the center side may be arranged to be effectively cooled.

SUMMARY OF THE INVENTION

The invention is directed to an EGR cooler comprising tubes and a shell enclosing said tubes, cooling water being supplied into and discharged from said shell, exhaust gas being guided from a diesel engine into said tubes for thermal exchange of said exhaust gas with said cooling water, and wherein a bypass flow path for guiding the cooling water is arranged in said shell so as not to cause stagnation of the cooling water in said shell. The bypass flow path may comprise a bypass conduit; it may comprise an inner space of the shell formed by reducing the number of the tubes; and/or it may be formed by peripherally curving the shell. An outlet of the bypass flow path may be positioned within the cooling water outlet.

Thus, the cooling water is guided via the bypass flow path so as not to cause stagnation of the cooling water in the shell and to prevent cooling water stagnation zones from being generated, thereby suppressing locally higher temperature of the tubes. Moreover, the bypass flow path arranged in the shell does not interfere with peripheral devices of the shell, thereby improving the mountability onto a vehicle. When the bypass flow path comprises the bypass conduit, then the cooling water is accurately guided to prevent the water stagnation zones from being generated and positively suppress localized higher temperature of the tubes. When the bypass flow path comprises the inner space formed by reducing the number of the tubes, then the bypass flow path is simply formed to readily prevent stagnation of the cooling water and positively suppress localized higher temperature of the tubes. When the bypass flow path is formed by peripherally curving the shell, then the simple structure drastically reduces interference with peripheral devices of the shell, thereby readily improving the mountability onto a vehicle. When the outlet of the bypass flow path is arranged within the cooling water outlet, then the cooling water in the bypass flow path is sucked by negative pressure at the cooling water outlet so that the cooling water is further accurately guided to prevent stagnation of the cooling water, thereby further positively suppress locally higher temperature of the tubes.

The invention is also directed to an EGR cooler comprising tubes and a shell enclosing said tubes, cooling water being supplied into and discharged from said shell, exhaust gas being guided from a diesel engine into said tubes for thermal exchange of said exhaust gas with said cooling water, and wherein the respective tubes are arranged in the form of multiple concentric circles about an axis of the shell, pitches between the tubes constituting the respective concentric circles being gradually increased from outer to inner ones of the circles.

Thus, since the pitches between the tubes constituting the respective circles are gradually increased from outer to inner ones of the circles, cooling water supplied to the shell flows much around the tubes on the center side to effectively cool the same. As a result, localized thermal deformation can be prevented to improve the heat exchange efficiency even if the hot exhaust gas tends to flow much through the tubes on the center side.

The invention is also directed to an EGR cooler comprising tubes and a shell enclosing said tubes, cooling water being supplied into and discharged from said shell, exhaust gas being guided from a diesel engine into said tubes for thermal exchange of said exhaust gas with said cooling water, and wherein the respective tubes are arranged in the form of multiple concentric circles about an axis of the shell, pitches between the respective multiple circles constituted by the tubes being gradually increased radially from the periphery to the axis of the shell.

Thus, since the pitches between the multiple circles are gradually increased radially from the periphery to the axis of the shell, the cooling water supplied to the shell flows much around the tubes on the center side to effectively cool the same. As a result, localized thermal deformation can be prevented to improve the heat exchange efficiency even if the hot exhaust gas tends to flow much through the tubes on the center side.

The invention is also directed to an EGR cooler comprising tubes and a shell enclosing said tubes, cooling water being supplied into and discharged from said shell, exhaust gas being guided from a diesel engine into said tubes for thermal exchange of said exhaust gas with said cooling water, and wherein the respective tubes are arranged in the form of multiple concentric circles about an axis of the shell, pitches between the tubes constituting the respective circles being gradually increased from outer to inner ones of the circles, pitches between the multiple circles constituted by the tubes being gradually increased radially from the periphery to the axis of the shell.

Thus, since the pitches between the tubes on the center side constituting the respective circles are gradually increased from the outer to inner ones of the circles and the pitches between the circles are also gradually increased from the periphery to the axis of the shell, the cooling water supplied to the shell flows much around the tubes on the center side to effectively cool the same. As a result, localized thermal deformation can be positively prevented to further improve the heat exchange efficiency even if the hot exhaust gas tends to flow much through the tubes on the center side.

In this case, the central tube may be positioned at the axis of the shell with the pitch between the innermost circle of the tubes and the central tube being made greatest. Thus, since the pitch of the circle on the center side is great to the central tube through which exhaust gas flows most, the cooling water supplied to the shell flows much around the central tube to effectively cool the same. As a result, local thermal deformation can be positively and readily prevented to still further improve the heat exchange efficiency even if the hot exhaust gas tends to flow much through the central tube.

BEST MODE FOR CARRYING OUT THE INVENTION

Now, embodiments of the invention will be described in conjunction with the drawings.

Figure 1:
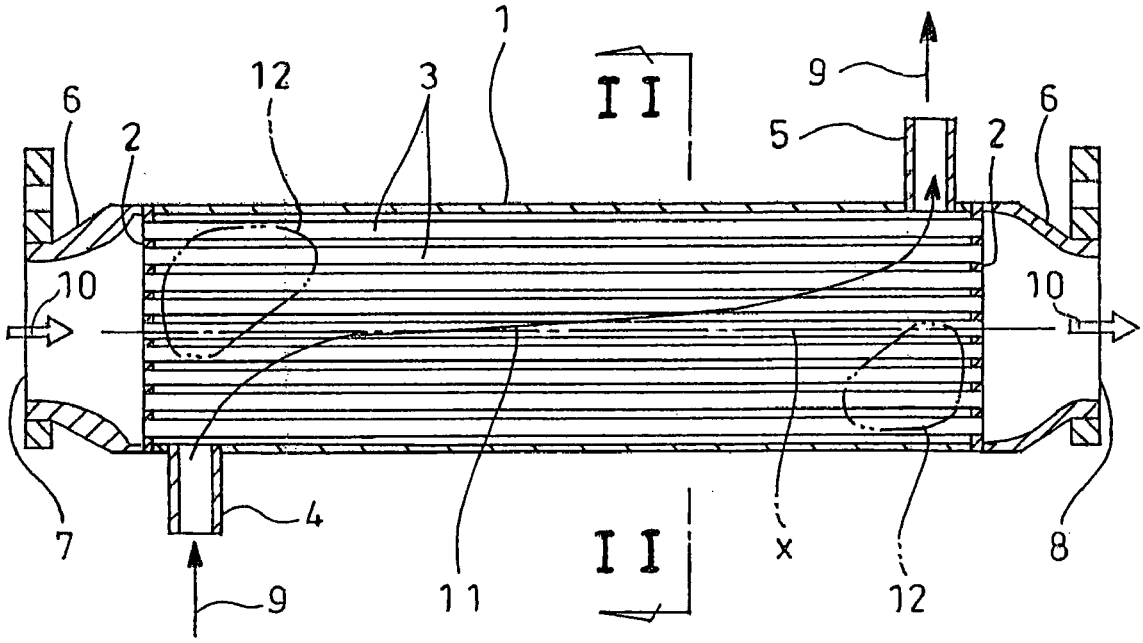
FIG. 1 PRIOR ART
FIG. 1 is a sectional side elevation showing a first example of a conventional EGR cooler.
Figure 2:
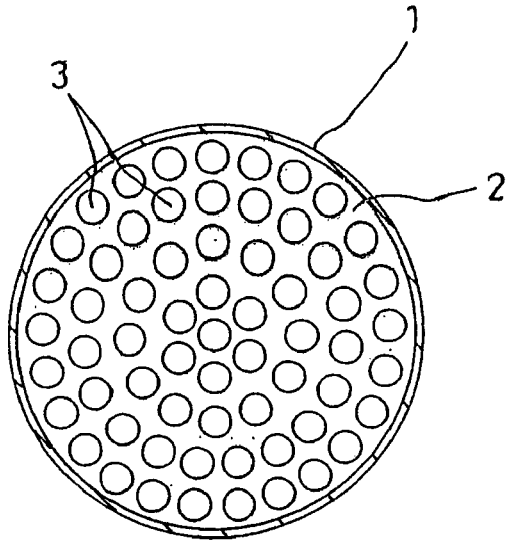
FIG. 2 PRIOR ART
FIG. 2 is a sectional view looking in the direction of arrows II in FIG. 1.
Figure 3:
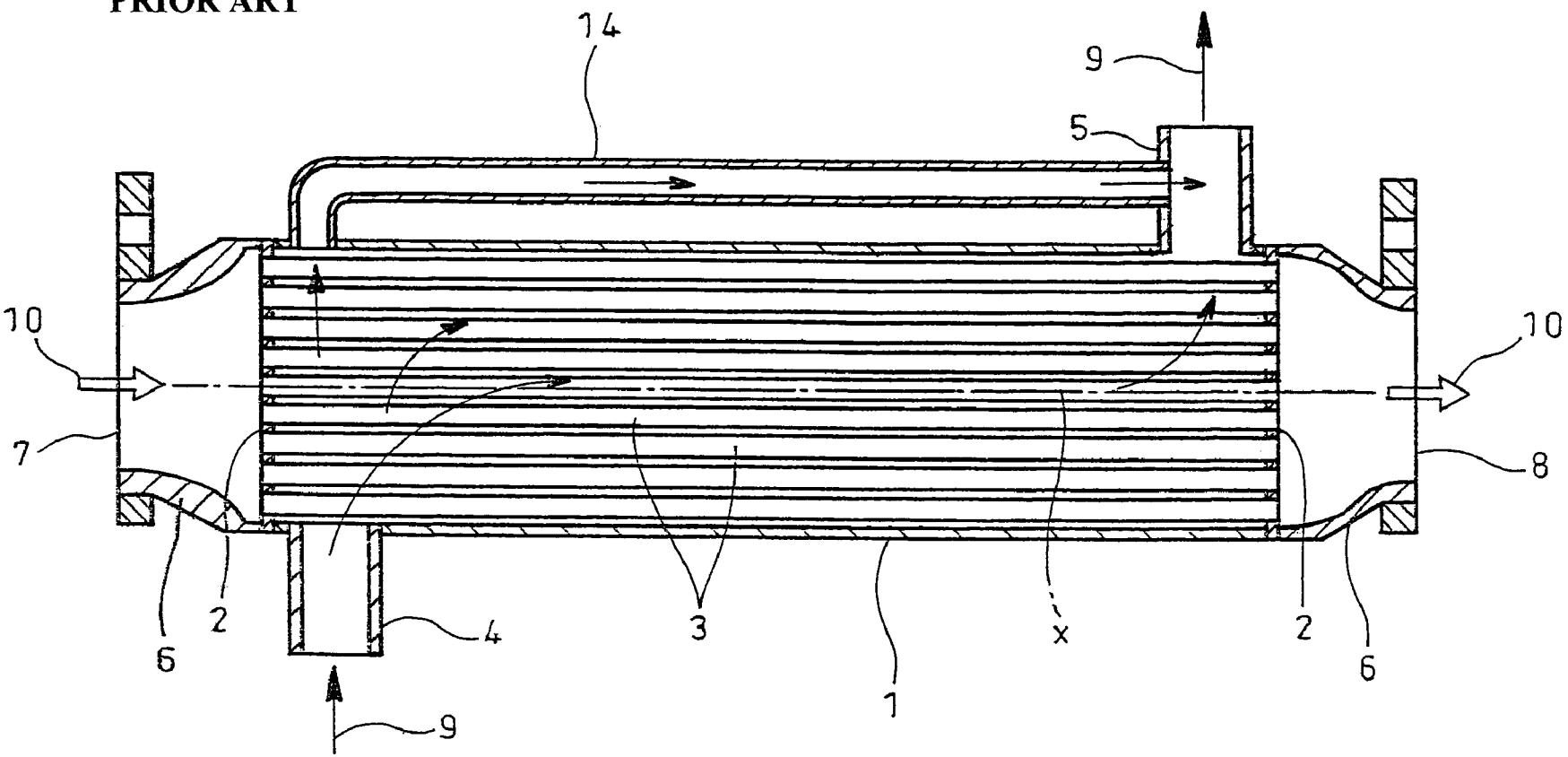
FIG.3 PRIOR ART
FIG. 3 is a sectional side elevation showing a second example of the conventional EGR cooler.
Figure 4:
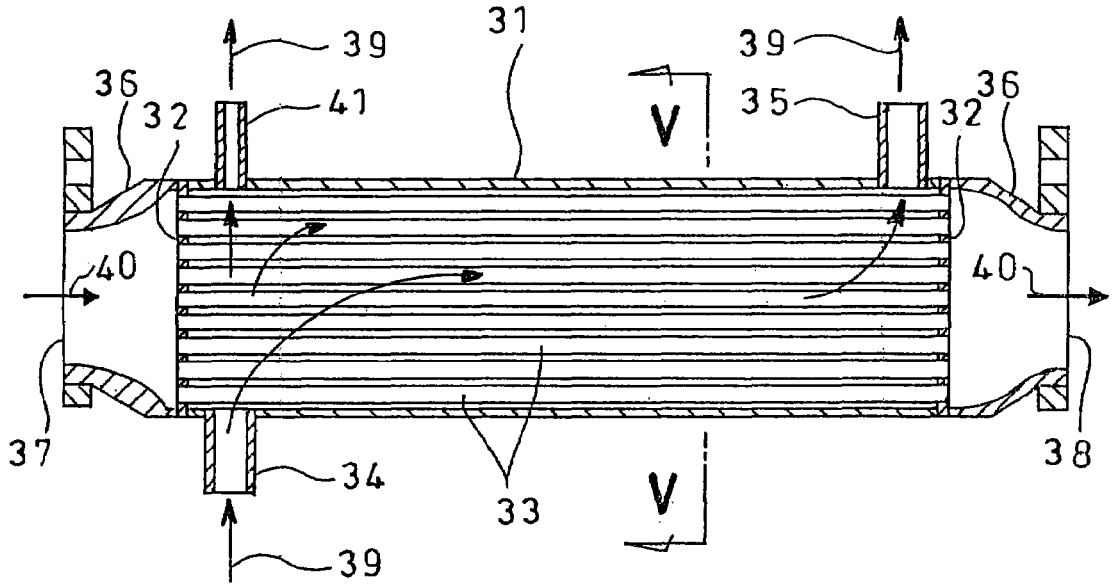
FIG.4 PRIOR ART
FIG. 4 is a sectional elevation showing a third example of the conventional EGR cooler.
Figure 5:
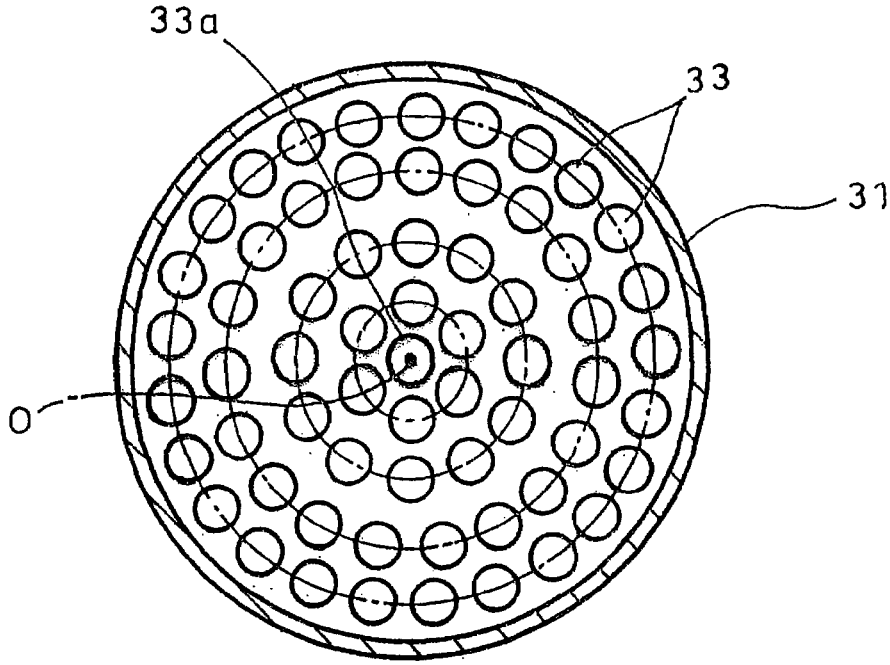
FIG. 5 is a sectional view looking in the direction of arrows V in FIG. 4.
Figure 6:
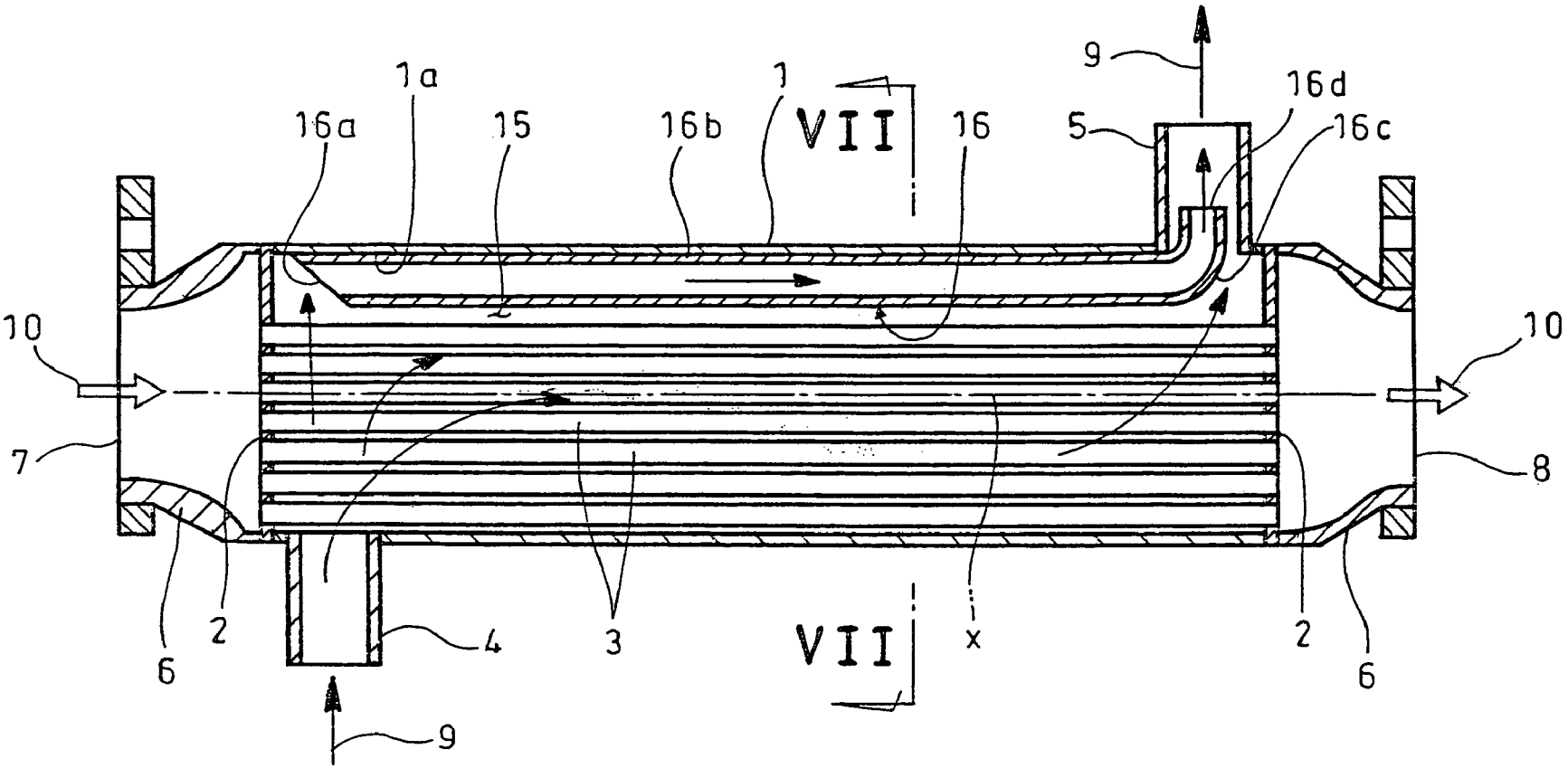
FIG. 6 is a sectional side elevation showing a first embodiment of the invention.
Figure 7:
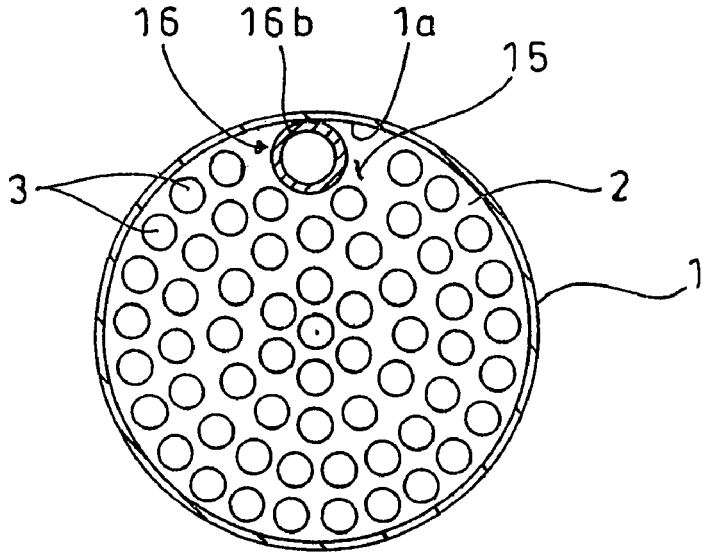
FIG. 7 is a sectional view looking in the direction of arrows VII in FIG. 6.

FIGS. 6 and 7 show a first embodiment of the invention in which the parts similar to those in FIGS. 1 to 3 are designated by the same reference numerals.

In an EGR cooler according to the first embodiment, the number of tubes 3 arranged in a shell 1 is reduced to provide a predetermined inner space 15 on an upper side within the shell 1 defined by an inner surface 1*a* of the shell 1, plates 2 and the tubes 3. In order to provide a bypass flow path for cooling water 9 in the space 15, a single bypass conduit 16 extends along the axis of the shell 1 and is fixed to the inner surface 1*a* of the shell 1 by, for example, welding or brazing.

The conduit 16 has a bypass inlet 16*a* formed at a position diametrically opposite to a cooling water inlet 4 of the shell 1 and extends axially of the shell 1 as a bypass body 16*b* into a cooling water outlet 5 via a bent portion 16*c* to form a bypass outlet 16*d* midway of the outlet 5. Cross sectional area of the flow path in the conduit 16 is preferably set to 5-15% of a total cooling water content in accordance with flow analysis, actual device test and the like, the inlet 16*a* being beveled to have an inlet area widened downwardly.

Now, an operation of the first embodiment of an EGR cooler according to the invention will be described.

When the cooling water 9 is supplied via the inlet 4 into the shell 1 for heat exchange with exhaust gas 10, the water 9 flows via the inlet 4 into the shell 1 and is heat exchanged with the exhaust gas 10 through the tubes 3 and is discharged from the outlet 5 while the cooling water 9 is suctioned into the conduit 16 due to the negative pressure at the outlet 5, so that part of the cooling water 9 flows to a position diametrically opposite to the inlet 4.

Thus, according to the first embodiment, the cooling water 9 is guided by the bypass flow path into the position diametrically opposite to the inlet 4 to thereby prevent stagnation of the cooling water 9 in the shell 1. Further, arrangement of the bypass flow path not outside of the shell 1 but within the shell 1 eliminates interference with peripheral devices of the shell 1 to improve mountability onto a vehicle.

Since the bypass flow path is provided by the conduit 16, the cooling water 9 is properly guided to positively prevent cooling water stagnation zones from generated. Since the bypass outlet 16*d* is arranged within the cooling-water outlet 5, the cooling water 9 in the bypass flow path is sucked under negative pressure at the outlet 5 to further properly guide the cooling water and further positively prevent generation of the cooling water stagnation zones. Since the cross sectional area of the flow path in the conduit 16 is set to 5-15% of the total cooling water content, prevention of the cooling water stagnation zones and attainment of higher heat exchange efficiency can be made in a balanced manner. If the cross sectional area of the flow path in the conduit 16 is set to less than 5% of the total cooling water content, the cooling water stagnation zones cannot be suitably prevented. On the other hand, if the cross sectional area of the flow path in the conduit 16 is set to more than 15% of the total cooling water content, comfortable use cannot be attained due to decreased heat exchange efficiency.

Figure 8:
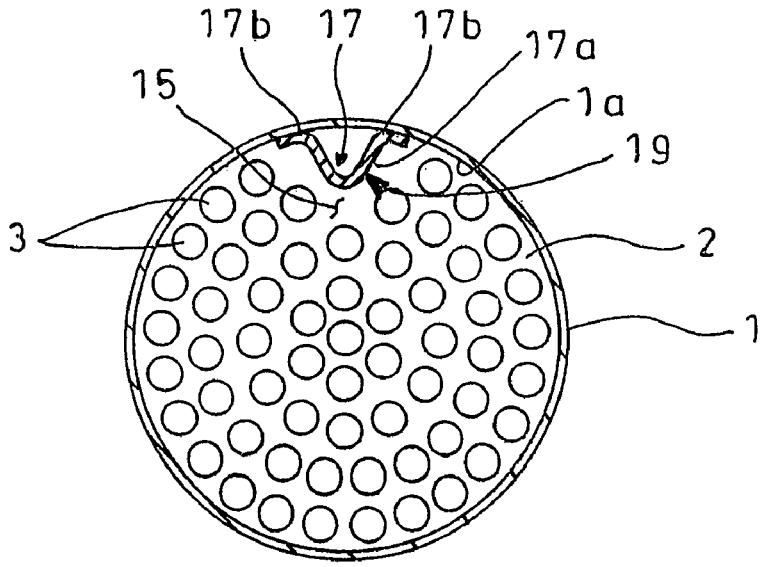
FIG. 8 is a sectional view showing a second embodiment of the invention.
Figure 9:
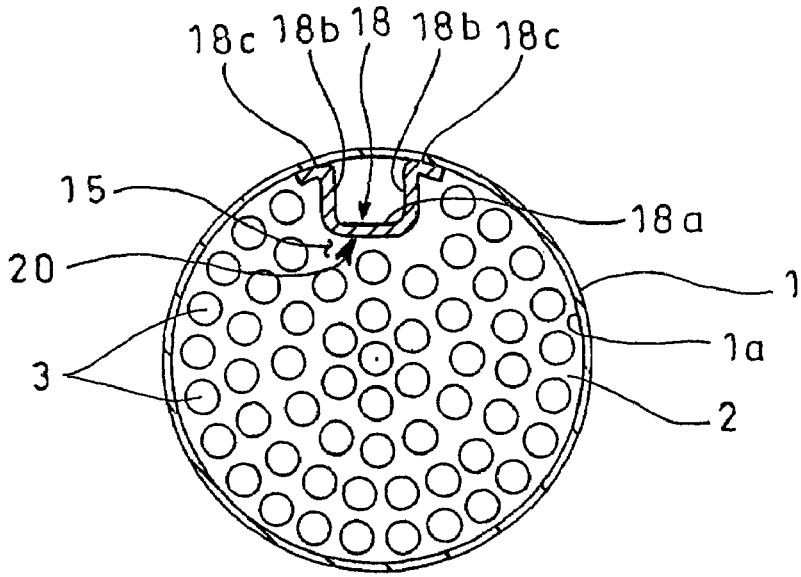
FIG. 9 is a sectional view showing a third embodiment of the invention.

FIGS. 8 and 9 show second and third embodiments of the invention, respectively, in which parts similar to those in FIGS. 1 to 3 are represented by the same reference numerals.

In an EGR cooler according to the second embodiment, the number of tubes 3 arranged in a shell 1 is reduced to provide a predetermined inner space 15 on the upper side within the shell 1 defined by an inner surface 1*a* of the shell 1, plates 2 and the tubes 3, a curved bypass member 17 being fixed to the inner surface 1*a* of the shell 1 by, for example, welding or brazing to provide a bypass conduit 19 along an axis of the shell 1 so as to provide a bypass flow path for cooling water 9 in the space 15. The bypass member 17 of the second embodiment is in the form of a groove extending along the axis of the shell 1, is V-shaped in vertical cross section as shown at 17*a* and is fixed at its upper ends or fixing portions 17*b* to the inner surface 1*a* of the shell 1 by, for example, welding or brazing.

An EGR cooler according to the third embodiment is substantially similar to that in the second embodiment; the number of tubes 3 arranged in a shell 1 is reduced to provide a predetermined inner space 15 on the upper side within the shell 1 defined by an inner surface 1*a* of the shell 1, plates 2 and the tubes 3, a curved bypass member 18 being fixed to the inner surface 1*a* of the shell 1 by, for example, welding or brazing to provide a bypass conduit 20 along an axis of the shell 1 so as to form a bypass flow path for cooling water 9 in the space 15. The bypass member 18 of the third embodiment is in the form of a groove extending along the axis of the shell 1 and has a base 18*a* and two sides 18*b* in vertical cross section, each of said two sides having a fixing portion 18*c* at its upper end which is fixed to the inner side 1*a* of the shell 1 by, for example, welding or brazing.

The bypass conduit 19 or 20 of the second or third embodiment, respectively, is substantially similar to that in the first embodiment and has a bypass inlet formed at a position diametrically opposite to a cooling water inlet 4 of the shell 1 and extends axially of the shell 1 as a bypass body into a cooling water outlet 5 via a bent portion to form a bypass outlet midway of the outlet 5. Substantially as in the case of the first embodiment, cross sectional area of the flow path in the conduit 19 or 20 is preferably set to 5-15% of a total cooling water content in accordance with flow analysis, actual device test and the like.

Now, effects of the second or third embodiment of the invention will be described.

In this manner, according to the second or third embodiment, the amount of members required for the bypass conduit 19 or 20 is reduced to provide it inexpensively. The second or third embodiment can obtain substantially the same effects and advantages as those in the first embodiment.

Figure 10:
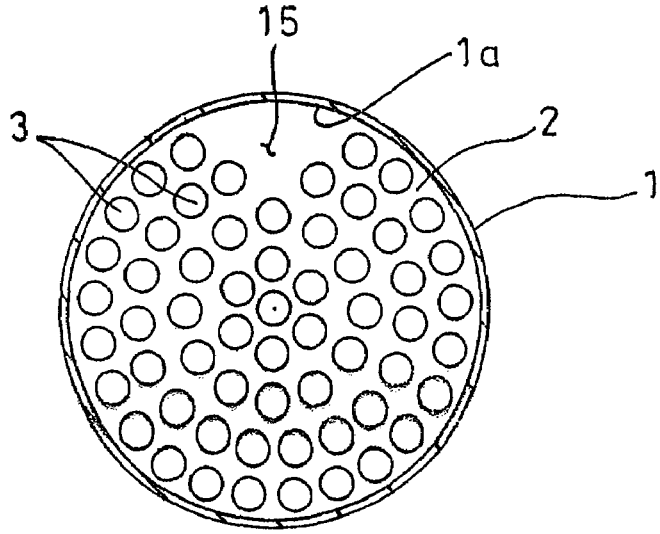
FIG. 10 is a sectional view showing a fourth embodiment of the invention.

FIG. 10 shows a fourth embodiment of the invention in which parts similar to those in FIGS. 1 to 3 are designated by the same reference numerals.

In an EGR cooler according to the fourth embodiment, the number of tubes 3 arranged in a shell 1 is reduced to provide a predetermined inner space 15 on an upper side within the shell 1 defined by an inner surface 1*a* of the shell 1, plates 2 and the tubes 3, said space 15 serving as a bypass flow path for cooling water 9. Cross sectional area of the flow path in the bypass conduit is preferably set to 5-15% of a total cooling water content substantially as in the case of the first embodiment in accordance with flow analysis, actual device test and the like.

Now, effects of the fourth embodiment of an EGR cooler according to the invention will be described.

As shown in the fourth embodiment, when the inner space 15 of the shell 1 formed by reducing the number of the tubes 3 serves as a bypass flow path, the bypass flow path is readily provided to easily prevent generation of cooling water stagnation zones, positively suppressing localized high temperature of the tubes 3. The bypass flow path is provided further inexpensively since it is formed without members. According to the fourth embodiment, substantially the same effects and advantages as those in the first embodiment can be obtained.

Figure 11:
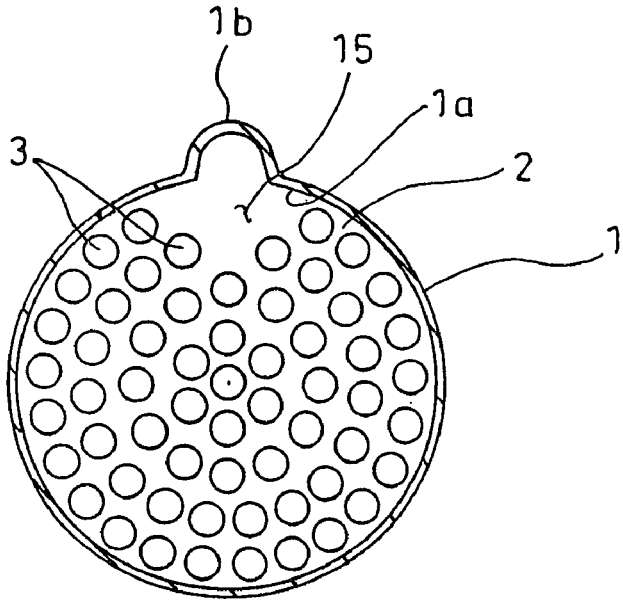
FIG. 11 is a sectional view showing a fifth embodiment of the invention.
Figure 12:
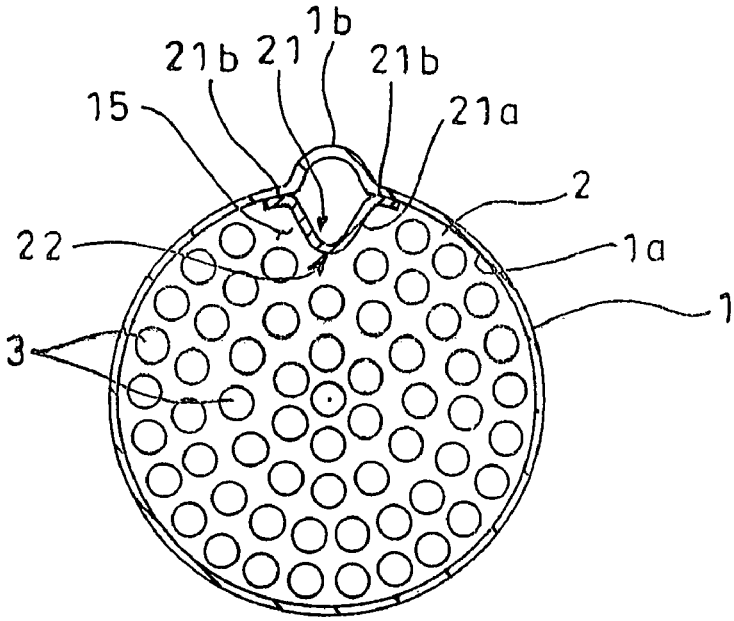
FIG. 12 is a sectional view showing a sixth embodiment of the invention.

FIGS. 11 and 12 show fifth and sixth embodiments of the invention, respectively in which the parts similar to those in FIGS. 1 to 3 are designated by the same reference numerals.

In an EGR cooler according to the fifth embodiment, the number of tubes 3 arranged in a shell 1 is reduced to provide a predetermined inner space 15 on an upper side within the shell 1 defined by an inner surface 1*a* of the shell 1, plates 2 and the tubes 3 while an upper periphery 1*b* of the shell 1 is curved upward along an axis of the shell 1 to expand the inner space 15 of the shell 1, said space 15 serving as a bypass flow path for cooling water 9. Cross sectional area of the flow path in the bypass conduit is preferably set to 5-15% of a total cooling water content substantially as in the case of the first embodiment in accordance with flow analysis, actual device test and the like.

In an EGR cooler according to the sixth embodiment, in order to form a bypass flow path in a predetermined inner space 15 of the fifth embodiment, a curved bypass member 21 is fixed to an inner surface 1*a* of a shell 1 by, for example, welding or brazing to provide a bypass conduit 22 along an axis of the shell 1. Substantially similarly to the bypass member 17 of the second embodiment, the bypass member 21 of the sixth embodiment is in the form of a groove extending along the axis of the shell 1, is V-shaped in vertical cross section as shown at 21*a* and is fixed at its upper ends or fixing portions 21*b* to the inner surface 1*a* of the shell 1 by, for example, welding or brazing. Substantially similarly to that in the first embodiment, the bypass conduit 22 of the sixth embodiment has a bypass inlet formed at a position diametrically opposite to a cooling water inlet 4 of the shell 1 and extends axially of the shell 1 as a bypass body into a cooling water inlet 5 via a bent portion to form a bypass outlet midway of the outlet 5. Substantially as in the case of the first embodiment, cross sectional area of the flow path in the bypass conduit 22 is preferably set to 5-15% of a total cooling water content in accordance with flow analysis, actual device test and the like.

Now, effects of the fifth and sixth embodiments of the invention will be described.

As described in the fifth and sixth embodiments, a bypass flow path with the periphery 1*b* of the shell 1 curved simplifies its formation to significantly reduce interference with peripheral devices of the shell 1, readily improving mountability onto a vehicle. According to the fifth and sixth embodiments, effects and advantages substantially similar to those in the first embodiment can be obtained.

It is to be understood that the EGR cooler of the invention is not limited to the above embodiments and that various changes and modifications may be made without departing from the scope of the invention. For example, the number of pipes to be reduced is any; there are no particular limitations on the shape of a bypass flow path as long as it has predetermined cross sectional characteristic.

Figure 13:
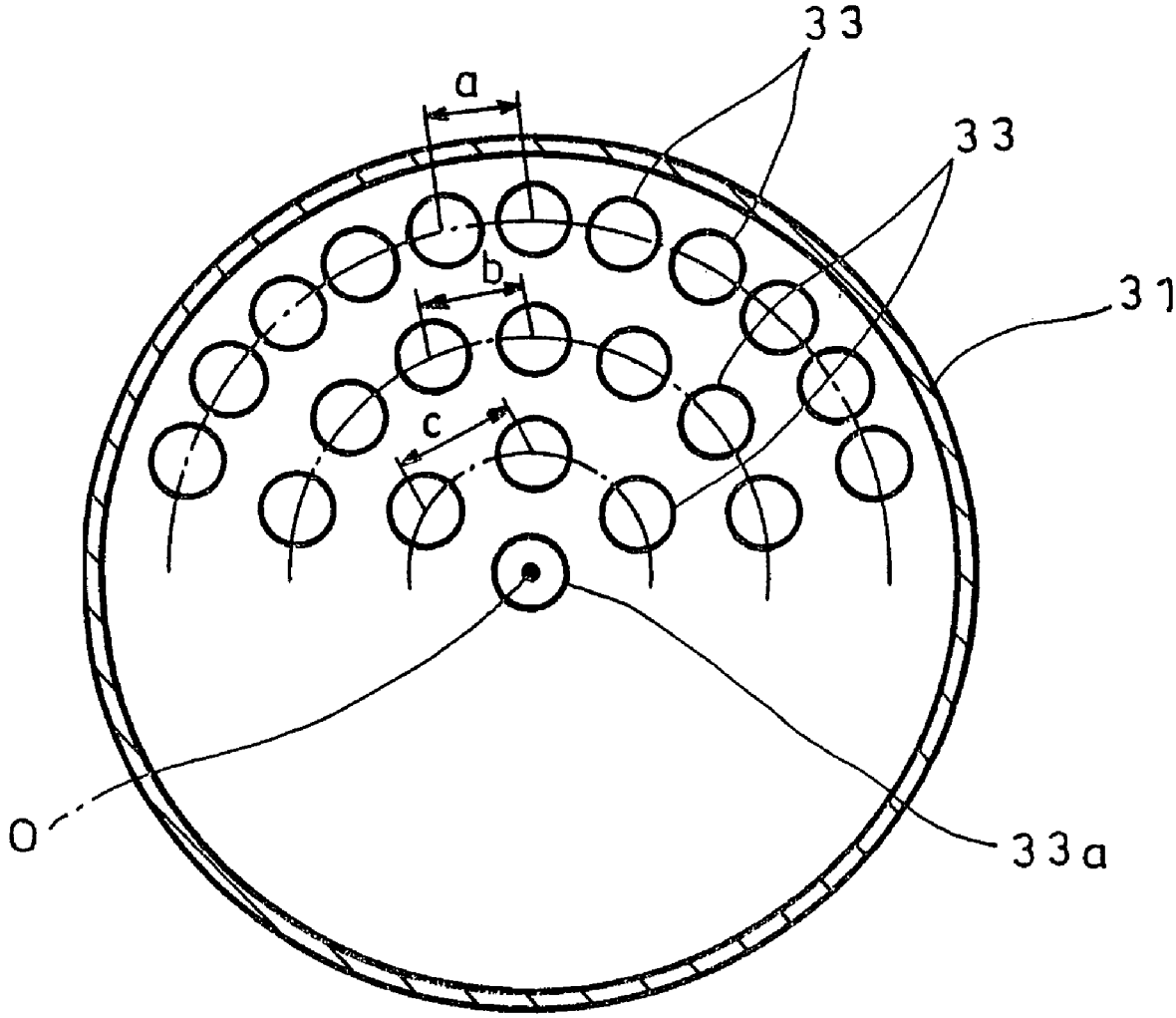
FIG. 13 is a schematic sectional view showing a seventh embodiment of the invention.

FIG. 13 shows a seventh embodiment of the invention.

In the seventh embodiment, a plurality of tubes 33 with the same diameter are arranged in the form of concentric multiple circles about an axis O of a shell 31, the peripheral tubes 33 being positioned along the shell 31 while a central tube 33*a* is positioned at the axis O of the shell 31. Pitches a, b and c between the tubes constituting the concentric multiple circles are gradually increased from outer to inner ones of the circles.

The description will be given specifically on an occasion where the plural tubes 33 are arranged to provide triple circles around the central tube 33*a*. As shown in FIG. 13, a first pitch a between the tubes in the outermost circle, a second pitch b between the tubes in the second outer circle and a third pitch c between the tubes in the third outer circle are increased in the order named (a<b<c). The pitch a, b or c between the tubes means a distance between axes of adjacent tubes 33 arranged in the form of circle.

Thus, according to the seventh embodiment, the pitches a, b and c between the tubes constituting the respective concentric circles are gradually increased from outer to inner ones of the circles, so that cooling water supplied to the shell 31 flows much around the tubes 33 and 33*a* on the center side to efficiently cool the same. As a result, local thermal deformation can be prevented to improve the heat exchange efficiency even if the hot exhaust gas tends to flow much through the tubes 33 and 33*a* on the center side.

Figure 14:
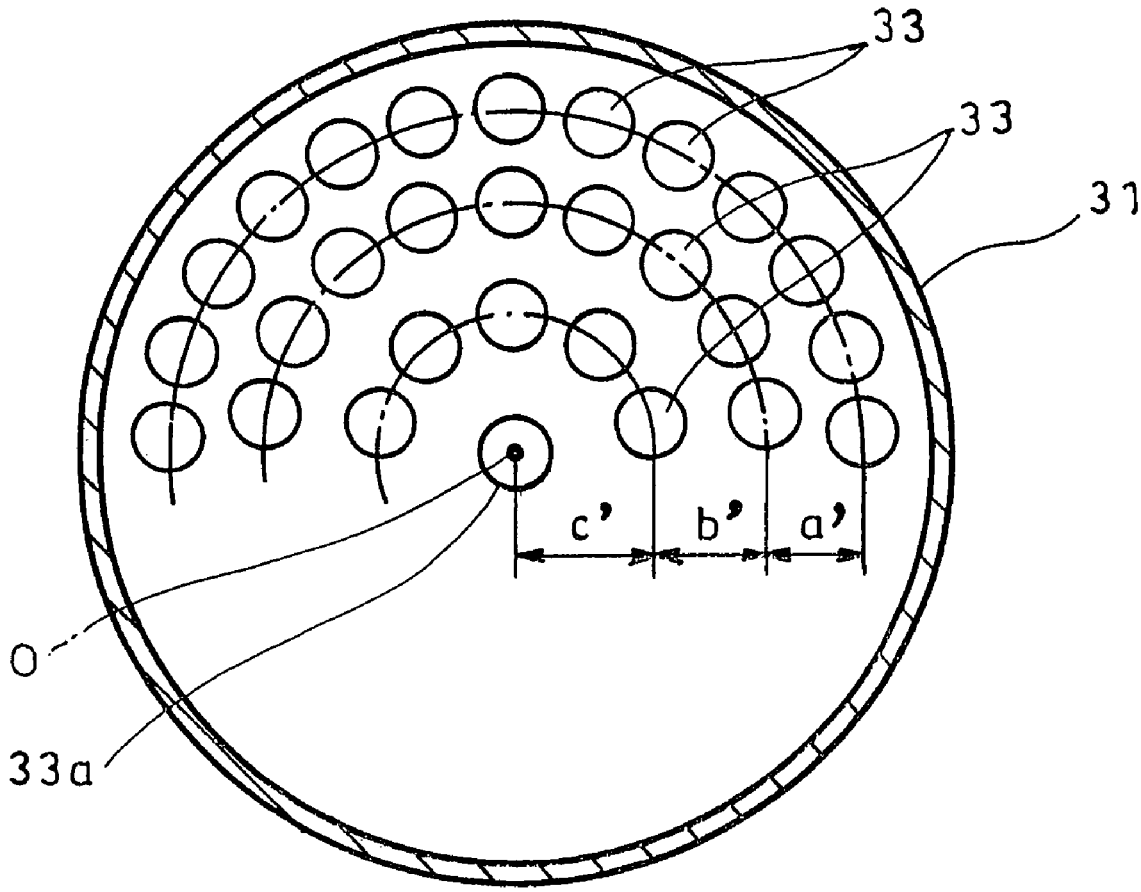
FIG. 14 is a schematic sectional view showing an eighth embodiment of the invention.

FIG. 14 shows an eighth embodiment of the invention.

In the eighth embodiment, a plurality of tubes 33 with the same diameter are arranged in the form of concentric multiple circles about an axis O of a shell 31, the peripheral tubes 33 being positioned along the shell 31 while a central tube 33*a* is positioned at the axis O of the shell 31. Pitches a', b' and c' between the concentric multiple circles constituted by the tubes are gradually increased radially from the periphery to the axis of the shell 31.

The description will be given specifically on an occasion where the plural tubes 33 are arranged to provide triple circles around the central tube 33*a*. As shown in FIG. 14, a first pitch a' between the outermost and second outer circles constituted by the tubes 33, a second pitch b' between the second and third outer circles constituted by the tubes 33 and a third pitch c' between the third outer circle constituted by the tubes 33 and the central tube 33*a* are increased in the order named (a'<b'<c'). The pitch a', b' or c' between the circles means a distance between axes of adjacent tubes 33 radially of the shell 31.

Thus, according to the eighth embodiment, the pitches a', b' and c' between the multiple circles constituted by the tubes are gradually increased radially from the periphery to the axis of the shell 31, so that cooling water supplied to the shell 31 flows much around the tubes 33 and 33*a* on the center side to effectively cool the same. As a result, localized thermal deformation can be prevented to improve the heat exchange efficiency even if the hot exhaust gas tends to flow much through the tubes 33 and 33*a* on the center side.

With the central tube 33*a* being arranged at the axis of the shell 31, the pitch c' between the innermost circle and the central tube 33*a* is made greatest, with the pitch c' of the circle on the center side being great to the central tube 33*a* through which the exhaust gas flows most, so that the cooling water supplied to the shell flows much around the central tube 33*a* to efficiently cool the same. As a result, localized thermal deformation can be positively and readily prevented to still further improve the heat exchange efficiency even if the hot exhaust gas tends to flow much through the central tube 33*a*.

Figure 15:
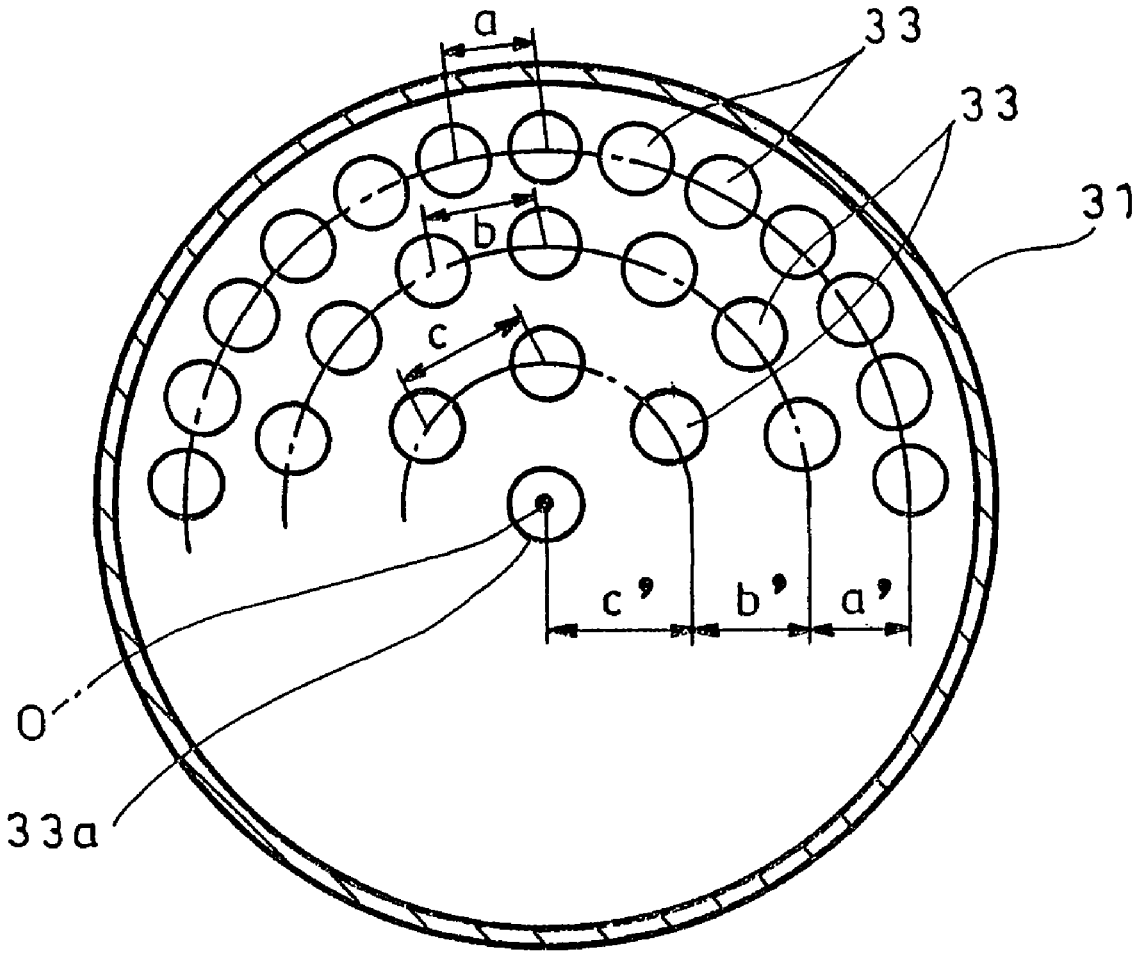
FIG. 15 is a schematic sectional view showing a ninth embodiment of the invention.

FIG. 15 shows a ninth embodiment of the invention.

In the third embodiment, a plurality of tubes 33 with the same diameter are arranged in the form of concentric multiple circles about an axis O of a shell 31, the peripheral tubes 33 being positioned along the shell 31 while a central tube 33*a* is positioned at the axis O of the shell 31. Pitches a, b and c between the tubes constituting the concentric multiple circles are gradually increased from outer to inner ones of the circles; pitches a', b' and c' between the concentric multiple circles constituted by the tubes are gradually increased radially from the periphery to the axis of the shell 31.

The description will be given specifically on an occasion where the plural tubes 33 are arranged to provide triple circles around the central tube 33*a*. As shown in FIG. 15, a first pitch a between the tubes in the outermost circle, a second pitch b between the tubes in the second outer circle and a third pitch c between the tubes in the third outer circle are increased in the order named (a<b<c). Further, a first pitch a' between the outermost and second outer circles constituted by the tubes 33, a second pitch b' between the second and third outer circles constituted by the tubes 33 and a third pitch c' between the third outer circle constituted by the tubes 33 and the central tube 33*a* are increased in the order named (a'<b'<c'). In this connection, the pitch a, b or c between the tubes means, substantially similarly to the first embodiment, a distance between axes of adjacent tubes 33 arranged in the form of circle; the pitches a', b' and c' between the circles means, substantially similarly to the second embodiment, a distance between axes of adjacent tubes 33 radially of the shell 31.

Thus, according to the third embodiment, the pitches a, b and c between the tubes constituting the respective concentric circles are gradually increased from outer to inner ones of the circles; the pitches a', b' and c' between the multiple circles constituted by the tubes are gradually increased radially from the periphery to the axis of the shell 31. Thus, cooling water supplied to the shell 31 flows much around the central tube 33*a* to efficiently cool the same. As a result, localized thermal deformation can be positively prevented to further improve the heat exchange efficiency even if the hot exhaust gas tends to flow much through the central tubes 33*a*.

With the central tube 33*a* being arranged at the axis of the shell 31, the pitch c' between the innermost circle and the central tube 33*a* is made largest; substantially similarly to the second embodiment, the pitch c' of the circle on the center is great to the central tube 33*a* through which the exhaust gas flows most, so that the cooling water supplied to the shell flows much around the tubes 33 and 33*a* on the center side to efficiently cool the same. As a result, localized thermal deformation can be positively and readily prevented to further improve the heat exchange efficiency even if the hot exhaust gas tends to flow much through the tubes 33 and 33*a* on the center side.

It is to be understood that the EGR cooler of the invention is not limited to the above embodiments and that various changes and modifications may be made without departing from the scope of the invention. For example, multiplicity in circles of the tubes arranged may be double or more than three.

INDUSTRIAL APPLICABILITY

As is clear from the above, an EGR cooler according to the invention attached to an EGR apparatus, which recirculates exhaust gas from a diesel engine to suppress generation of nitrogen oxides, so as to cool the exhaust gas to be recirculated is suited to prevent generation of cooling water stagnation zones to improve mountability onto a vehicle as well as suited to effectively cool the tubes on the center side.

The invention claimed is:

1. An EGR cooler comprising:

tubes;

a shell enclosing said tubes;

a cooling water inlet, attached to an end of the shell, to supply cooling water into said shell;

a cooling water outlet, attached to another end of the shell, to discharge the cooling water from said shell;

a guide, attached to said shell, to guide gas into said tubes for thermal exchange of said gas with said cooling water; and a bypass conduit, arranged along an axis of and on a shell inner surface of said shell and positioned adjacent to the cooling water outlet, to guide the cooling water to a direction perpendicular to the flow of the cooling water through the inlet, said bypass conduit including, a bypass inlet formed at a position diametrically opposite to the cooling water inlet of the shell, a bypass body extending axially of said shell through the bypass inlet, and a bypass outlet extending via a bent portion into and positioned in the cooling water outlet.

2. A system comprising:

a diesel engine; and an EGR cooler including tubes, a shell enclosing said tubes, a cooling water inlet, attached to an end of the shell, to supply cooling water into said shell, a cooling water outlet, attached to another end of the shell, to discharge the cooling water from said shell, a guide, attached to said shell, to guide exhaust gas being guided from the diesel engine into said tubes for thermal exchange of said exhaust gas with said cooling water, and a bypass conduit, arranged along an axis of and on a shell inner surface of said shell and positioned adjacent to the cooling water outlet, to guide the cooling water to a direction perpendicular to the flow of the cooling water through the inlet, said bypass conduit including, a bypass inlet formed at a position diametrically opposite to the cooling water inlet of the shell, a bypass body extending axially of said shell through the bypass inlet, and a bypass outlet extending via a bent portion into and positioned in the cooling water outlet.

* * * * *